United States Patent [19]

Sullinger

[11] 4,403,664

[45] Sep. 13, 1983

[54] EARTH BORING MACHINE AND METHOD

[76] Inventor: Richard Sullinger, 32135 Cook Rd., North Ridgeville, Ohio 44039

[21] Appl. No.: 182,413

[22] Filed: Aug. 28, 1980

[51] Int. Cl.[3] ..... E21B 44/00

[52] U.S. Cl. ..... 175/24; 175/45; 175/62; 175/73; 299/1; 299/30

[58] Field of Search ..... 175/26, 45, 62, 61, 175/173, 93, 171, 24, 73, 76; 299/1, 30

[56] References Cited

U.S. PATENT DOCUMENTS

| | | | |
|---|---|---|---|
| 3,554,302 | 1/1971 | Adkins | 175/26 |
| 3,712,391 | 1/1973 | Coye | 175/26 |
| 3,857,449 | 12/1974 | Kimic | 175/26 |
| 4,014,574 | 3/1977 | Todd | 299/1 |
| 4,026,371 | 5/1977 | Takada et al. | 175/45 |
| 4,113,036 | 9/1978 | Stout | 175/45 |
| 4,181,360 | 1/1980 | Wilson | 299/1 |

*Primary Examiner*—William F. Pate, III

*Attorney, Agent, or Firm*—Antonelli, Terry & Wands

[57] ABSTRACT

An earth boring machine and method are disclosed. An above-ground reference line, such as a laser beam, is established for a hole to be bored. The direction of the reference line is detected. The direction of a cutting head of the boring machine in a bore hole is detected and signals of the detected direction are transmitted to a control unit for comparison with the reference line direction. The boring machine is controlled with, for example, cam actuated adjustable peripheral cutters on the cutting head so that the direction of the boring machine can be adjusted to that of the reference line.

31 Claims, 4 Drawing Figures

EARTH BORING MACHINE AND METHOD

BACKGROUND AND SUMMARY OF THE INVENTION

The present invention relates to an earth boring machine and a method of controlling such a machine for boring a hole through the earth.

Boring under streets, roads, railroads, and so forth has been a preferred method of installing utility lines such as sewer, water, gas, electric, telephone, etc. for some time where interruption of traffic would be inconvenient, hazardous or otherwise undesirable. Boring is generally used for the formation of holes having a diameter in the range of six inches through forty-eight inches and tunneling for holes larger than forty-eight inches.

Boring, such as horizontal boring for utility lines, as practiced today generally relies on the experience of the machine operator to attain a satisfactory hole. The most experienced operator, however, cannot always overcome the many obstacles to a satisfactory hole, i.e., gravity, rotational drift, varying ground conditions, rock, existing utilities and other obstructions. These difficulties increase drastically with longer bores.

There have been numerous prior art apparatus and methods proposed to overcome some of these difficulties but none has been suggested which compensates for most or all adverse conditions without serious drawbacks. For example, the apparatus disclosed in U.S. Pat. No. 3,857,449 requires a specially designed and built boring machine, requires hydraulic lines from a power unit to the cutting head, requires the use of a casing, and also requires augers with a large center tube and thus small flights which are not good for boring in stony ground.

The apparatus disclosed in U.S. Pat. No. 3,907,045 is likewise disadvantageous in that it requires a parallel pilot hole with pits at each end and an antenna inserted through the pilot hole. This prior art apparatus also requires several trailing electrical wires. The earth boring machine disclosed in U.S. Pat. No. 3,938,597 provides vertical adjustment only, requires the use of a casing with the machine, requires adding special control rods as boring progresses, and requires overcutting of the bore hole to accept the control rods. Such overcutting of the bore hole can be counter to good grade control.

Further, in U.S. Pat. No. 3,939,926, the earth boring machine, which is designed primarily for drilling through rock, requires multiple hydraulic lines and extensions thereto as boring progresses, requires overcutting of the bore hole and also the use of a casing with the machine. The device of U.S. Pat. No. 3,529,682 relates to location detection and guidance systems for a burrowing device but requires physical apparatus above the ground along the desired path. Such an arrangement is not practical across railroad tracks and roadways, for example.

An object of the present invention is to provide an earth boring machine and a method of controlling such a machine whereby the aforementioned disadvantages of known apparatus and methods are avoided. More specifically, an object of the present invention is to provide an apparatus and method wherein boring can be accomplished with or without a casing, wherein no interfering apparatus above ground is required, wherein no secondary excavations or pilot holes are required so that excavation is minimized, and wherein the present invention can be adapted to existing commercially available boring machines, requiring only a special cutting head and lead auger of the proper size and the attaching of a control unit according to the invention to the existing controls.

These and other objects of the present invention are attained by providing a remote controlled earth boring machine comprising means for boring a hole through the earth, means for detecting the direction of said boring means in a bore hole, means for adjusting the direction of said boring means in a bore hole, means for producing an above-ground reference line for a hole to be bored, means for detecting the direction of said reference line, and means for remotely controlling said adjusting means whereby the direction of said boring means can be adjusted to that of said reference line.

According to a preferred embodiment of the present invention the means for producing an above-ground reference line provides a laser beam as the reference line and the means for detecting the direction of the reference line includes a laser beam receiver means. The means for detecting the direction of the reference line detects both the horizontal direction or directional component of the reference line and the vertical direction or directional component of the reference line.

The present invention further includes the provision of a novel remote controlled earth boring machine comprising an adjustable cutting head, auger means connected to the cutting head, drive means for rotating the auger means and cutting head to bore a hole in the earth, means for detecting the direction of the cutting head in a bore hole, means for adjusting the direction of the cutting head in a bore hole, said means for adjusting including power source means for operating said adjusting means, said power source means being located within at least one of said auger means and said cutter head, and means for remotely controlling said adjusting means. With this remote controlled earth boring machine of the invention the direction of the cutting head in a bore hole can be adjusted without the necessity of multiple connections of hydraulic or electric lines, thus making the earth boring machine of the present invention adaptable to existing commercially available boring machines as referred to above.

Further, according to the present invention a remote controlled earth boring machine is provided which comprises a cutting head, auger means connected to said cutting head, drive means for rotating the auger means and cutting head to bore a hole in the earth, means for detecting the direction of the cutting head in a bore hole, said direction detecting means including a direction sensor located in or adjacent the cutting head and radio transmitting means for the wireless transmission of detected direction signals to a remote location, means for adjusting the direction of the cutting head in a bore hole, and means for remotely controlling the adjusting means. By the use of such a direction sensor and radio transmitting means for the wireless transmission of detected direction signals to a remote location, as discussed above, multiple connections of hydraulic or electric lines can be avoided and the invention can be adapted to existing commercially available boring machines.

The present invention further includes a method of boring a hole through the earth with an earth boring machine including a cutting head. The method comprises the steps of producing an above-ground reference line for a hole to be bored, determining the direction of said reference line, determining the direction of the cutting head in a bore hole, comparing the direction of the cutting head in the bore hole and the direction of the reference line for the hole to be bored, and controlling the cutting head to adjust the direction of the cutting head to the direction of said reference line. According to a preferred embodiment of the present invention the reference line is a laser beam and the step of determining the direction of the cutting head in a bore hole involves sensing the direction of the cutting head in a bore hole with a sensor and wirelessly transmitting detected direction signals to a remote location for the comparing step.

A further feature according to a preferred embodiment of an earth boring machine of the present invention is the provision of means for adjusting the direction of the boring means in a bore hole which includes a rotatable cam in an adjustable cutting head of the boring machine for adjusting the position of at least one and preferably a plurality of peripheral cutters in said cutting head. Push rod means extend between the cam and each adjustable peripheral cutter for adjusting the position of the respective cutters with relative rotation between the cam and the peripheral cutters. The means for adjusting the direction of the boring means further includes drive motor means for adjusting the position of the cam and power source means for operating the drive motor means, the power source means operating the drive motor means in response to the remote control means of the machine. Preferably, the drive motor means and power source means are located in a lead auger section of the auger means of the boring machine. In the preferred embodiment, the drive motor means is an electric motor and the power source means is a battery pack.

BRIEF DESCRIPTION OF THE DRAWINGS

These and other objects, features and advantages of the present invention will become more apparent from the following description when taken in connection with the accompanying drawings which show, for purposes of illustration only, one embodiment in accordance with the present invention, and wherein.

DETAILED DESCRIPTION OF THE DRAWINGS

Figure 1:
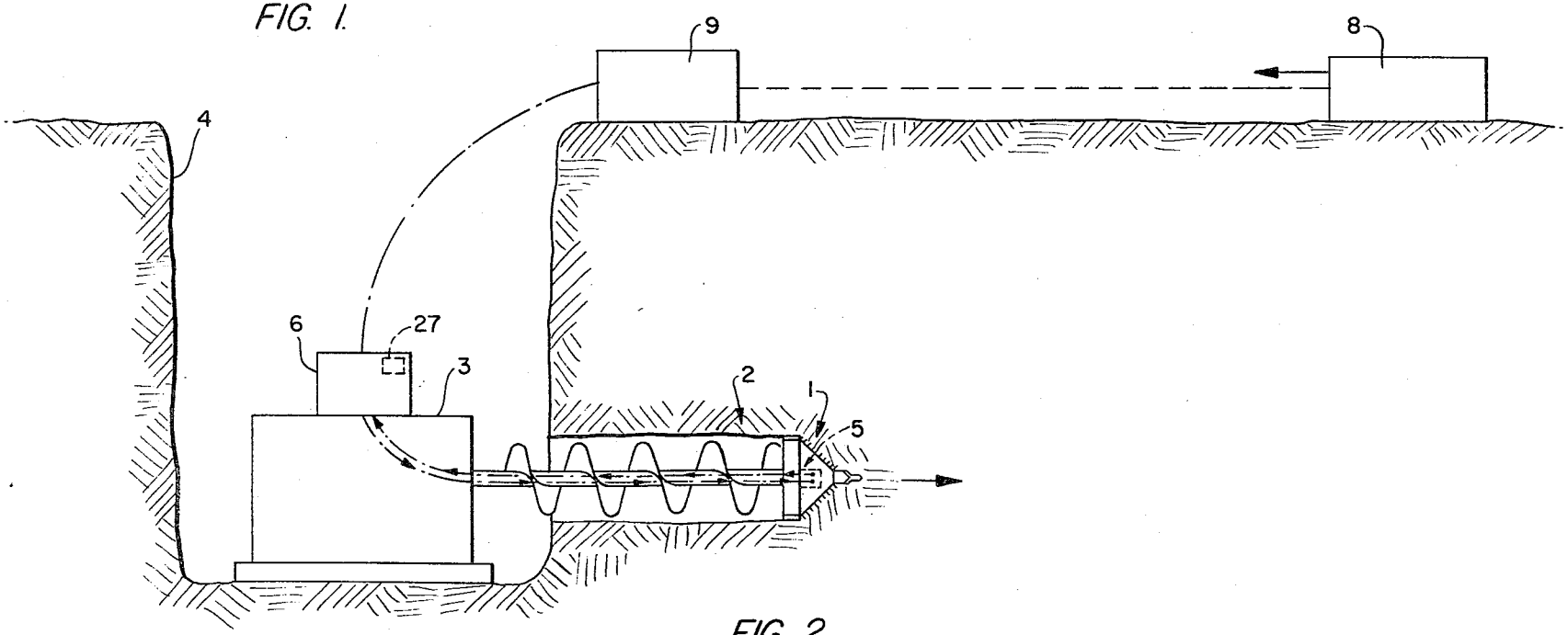
FIG. 1 is a schematic elevational view, partly in section, of a remote controlled earth boring machine of the present invention.

Referring now to FIG. 1 of the application drawings, a schematically illustrated remote controlled horizontal earth boring machine of the present invention is seen to comprise a cutting head 1 connected to a lead auger section 2. The cutting head, lead auger section and any suger sections connected thereto are rotated by a conventional drive unit 3 schematically illustrated in FIG. 1. This drive unit typically includes an internal combustion engine and transmission for rotatably driving the cutting head and auger section or sections for boring a hole in the earth. The drive unit 3 is positioned outside of the bore hole in a pit 4 adjacent one end of the bore hole. As readily understood by those skilled in the art, during the actual boring operation, the drive unit 3 is periodically disengaged from the auger sections and cutting head and additional auger sections are added. The drive unit 3 is typically mounted to a track by slides and/or rollers and means are provided for advancing the auger and cutting head into the bore hole during boring.

Figure 2:
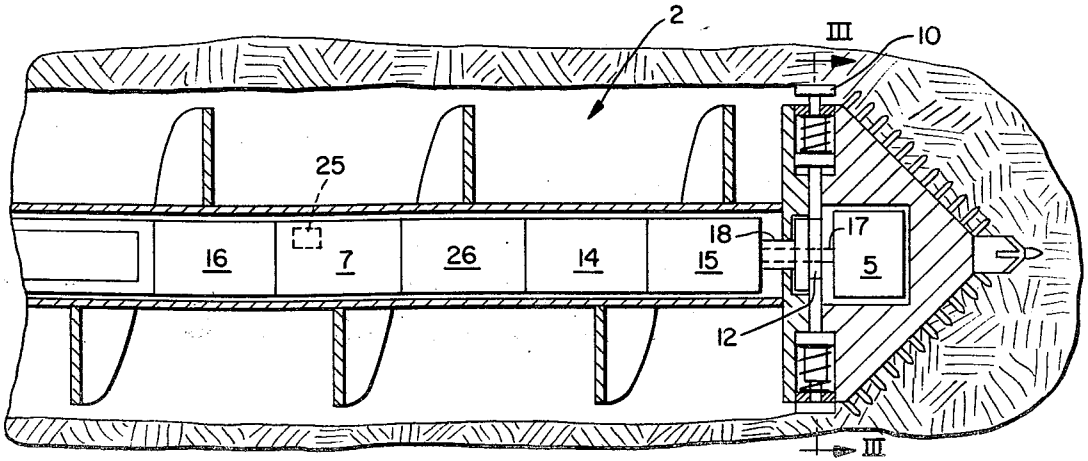
FIG. 2 is a schematic, cross-sectional view of a portion of the machine of FIG. 1, illustrating the lead auger section and cutting head.

The direction of the cutting head 1 and auger in a bore hole is detected by means of a direction sensor 5 in the cutting head.. Detected direction signals are wirelessly transmitted by a radio transmitter 25 to a remote control unit 6 which, in the illustrated embodiment, is positioned in the pit 4. The radio transmitter 25 for these direction signals is located in a control unit 7 positioned within the lead auger section 2 (see FIG. 2).

An above-ground reference line for a hole to be bored is produced by a laser beam emitting device 8. The laser beam emitting device 8 is positioned above, behind, or possibly in front of the site to which a bore hole is to be formed. From this position the laser beam emitted from the device 8 is directed back toward the pit 4 or location from which the bore hole is to be initiated. A laser beam receiving device 9 is positioned adjacent the pit 4 and along the line of the desired bore hole direction. The laser beam emitting device 8 and/or the laser beam receiving device 9 detect the direction of the laser beam. For example, the device or devices detect the horizontal direction or directional component of the reference line and the vertical direction or vertical directional component, that is, the grade of the reference line. This information is conveyed to the remote control unit 6 and represents a reference line for the desired line of travel for the cutting head 1 and auger 2.

The remote control unit 6 can be arranged so as to display the reference line direction information along side of the actual detected direction information of the cutting head and auger. In this way an operator can visually determine when, for example, the horizontal direction of the cutting head and auger devices from the horizontal direction of the reference line and thereafter remotely adjust the boring machine as discussed below so that the direction thereof corresponds to that of the reference line. Similarly, where the vertical direction or grade of the reference line deviates from that of the desired line of travel of a bore hole to be drilled, a like comparison and remote controlling is effected throughout the boring operation to ensure that the direction of the bore corresponds to that of the reference line that is, is parallel to the direction of the reference line.

Figure 3:
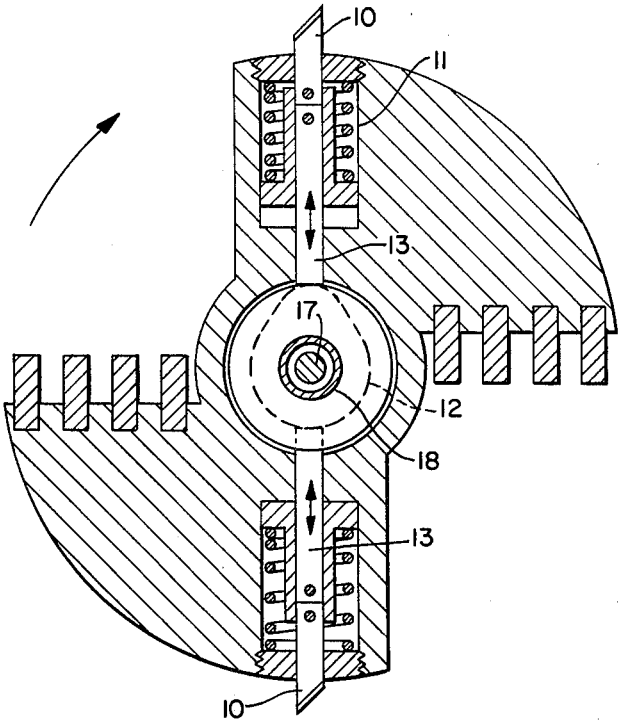
FIG. 3 is a schematic view of the cutting head of the boring machine of FIGS. 1 and 2 taken along the line III—III of FIG. 2 and illustrating the cooperative arrangement of the adjustable peripheral cutters, push rods and rotatable cam for adjusting the direction of the boring machine in a bore hole.

The direction of the cutting head in a bore hole is adjusted using adjustable peripheral cutters 10 provided in the cutting head 1. As shown in FIG. 3 of the drawings, two peripheral cutters 10 are oppositely disposed on the periphery of the cutting head and are biased in a retracted position by means of springs 11. A rotatable cam 12 interacts with the peripheral cutters by means of intermediate push rods 13 extending between the cam and the respective peripheral cutters. The cam 12 is normally held in a preselected, stationary position during rotation of the cutting head and auger. As a result, the adjustable cutters 10 are extended when the push rods pass over the single lobe on the cam 12. Extension of the adjustable peripheral cutters in a given direction effects a steering or directional adjustment of the cutting head and auger in the given direction. Therefore, by remotely controlling the position of the cam and its lobe, the cutting head and auger can be continuously controlled and its direction adjusted so that the actual travel direction corresponds to the desired travel direction of the reference line.

A drive cutting head adjusting motor 14 and gear reduction unit 15 are provided within the lead auger section for rotatably adjusting the cam 12. A power source 16 in the form of a battery pack is also positioned within the lead auger section and supplies the power requirements of the drive motor 14. This drive motor is remotely actuated by signals from a suitable radio transmitter 27 within remote control unit 6. These command signals are received by the control unit 7 within the lead auger section.

The laser beam emitting device 8 may be a conventional self-leveling laser such as the AGL SL-5 with tripod gimbal mount and scope. Such a laser is commonly used for pipe alignment. The emitting device is self-leveling and provides a lighted digital grade readout of, for example, "positive" to 20% and "negative" to 10% with a high degree of accuracy. Another suitable device of this type is the Spectra-Physics 1055 Dialgrade laser emitter which has two-axis level compensation. A dual grade counter on the device provides fast, easy reading of positive or negative grade settings with a grade range of −10% to +30%.

The laser beam receiving device 9 detects the laser beam from the emitting device and, for example, provides an indication of the horizontal direction of the laser beam reference line. The device, for example, may employ a directionally sensitive light detector of the type disclosed in U.S. Pat. No. 3,137,794. Such a detector provides an electrical signal output indicative of the angular deviation between luminous rays received from a light source and a predetermined reference direction. More specifically, the detector employs a prism of particular characteristics operated in conjunction with a pair of photosensitive elements, or photocells. The outputs of the photocells are connected to an electrical differential circuit which in turn provides an output signal having a polarity determined by the position of a light source with respect to the prism bisecting plane and an amplitude indicative of the angular deviation between the prism bisecting plane and the plane in which the light source lies. By rotatably mounting such a detector about a vertical axis, the electrical signal output of the detector can be used to align the prism bisecting plane with the laser beam received by the detector. Further, by mounting the detector on a magnetic compass a directional heading of the laser beam reference line from magnetic north can be readily determined.

The directional information from the laser beam emitting and receiving devices is conveyed to the remote control unit 6. This can be done merely by an operator recording the grade of the laser beam at the emitting device 8 and the direction of the beam at the receiving device 9 and manually entering such information into the control unit 6 where for example, it can be displayed for future use by the operator. Such directional information could also be automatically transmitted to the control unit 6 as will be readily apparent to the skilled artisan. For example, the laser beam receiving device 9 could be made to provide an electrical output signal representing the horizontal direction of the laser beam for transmittal to the control unit 6. Such a device could employ a field coil operating as a compass to align itself parallel to magnetic north when a DC current is passed through it. A multi-tap angular position potentiometer pick-off could be employed in such an arrangement to provide an indication of the relative angle between the field coil or magnetic north and a directionally sensitive light detector of the type referred to above which has been directed along the laser beam.

At the remote control unit 6 the horizontal and vertical direction of the reference line are displayed along side of the detected horizontal and vertical direction of the boring machine in the bore hole. The operator can, by comparing the displayed information, readily determine what, if any, correction is necessary so that the direction of the boring machine coincides with that of the reference line. If an adjustment is necessary, the operator can remotely adjust the position of the lobe on the rotatable cam 12 to adjust the direction of the cutting head. Of course, if desired, the remote control unit 6 could be fully automated so that the operator need not make the comparison of the horizontal and vertical directions of the reference line and boring machine nor the necessary steering adjustment when deviation from the reference directions is detected. This can be accomplished, for example, by encoding the signals from the boring sensor and the reference information, and using a suitably programmed microprocessor or other appropriate circuit to perform the desired comparison functions as will be apparent to the skilled artisan. In this latter case it is envisioned that the control unit 6 could actually be contained within the lead auger section 2 since, after receiving the necessary directional reference information, the necessary steering adjustments would be made automatically.

Figure 4:
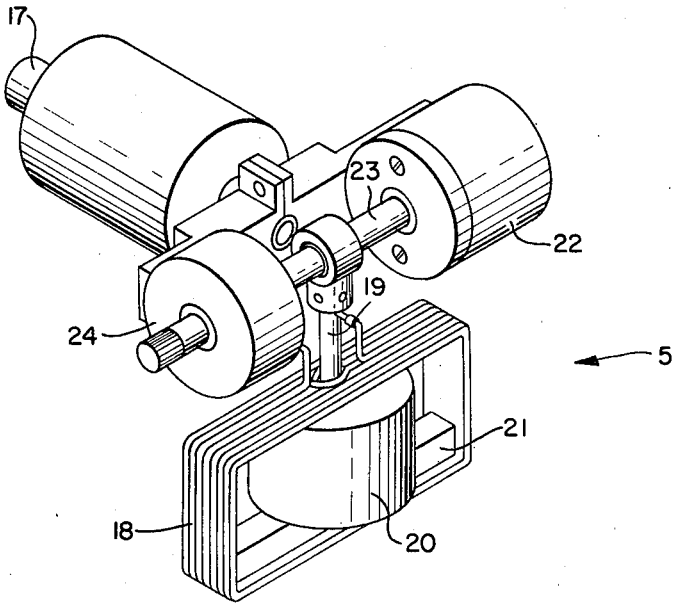
FIG. 4 is a schematic elevational view of a direction sensor which may be provided in the cutting head of the boring machine according to the present invention.

The direction sensor 5 in the cutting head may be of the type disclosed, for example, in U.S. Pat. No. 3,326,008 where, as illustrated in FIG. 4 of the application drawings, the direction relative to magnetic north is determined by a magnetic field coil 18 which aligns itself parallel to magnetic north. In turning to this position, the field coil 18 turns a shaft 19 which sets a potentiometer 20. The potentiometer 20 forms part of a Wheatstone bridge circuit which includes a potentiometer which may be set according to the desired horizontal direction. Thus, by adjusting the direction of the cutting head in the bore hole, the bridge circuit may be balanced and the boring machine can be placed on course. The balance or imbalance in the bridge circuit is wirelessly transmitted by the radio transmitter 25 in the control unit 7 within the lead auger section. Signals from the radio transmitter 25 are received in the remote control unit 6 where the directional information detected by the sensor 5 is displayed. Comparison by the operator of the detected direction with the reference line direction enables the operator to make the necessary directional adjustment of the boring machine by appropriately positioning the rotatable cam 12.

The direction sensor 5 is a three-axis positional sensor. The sensor is rotatably suspended from the shaft 17 extending through the cam 12. The shaft 17 passes through the hollow shaft 18 rotatably connecting the cam 12 with the gear reduction unit 15. Thus, the rotatable cam 12 and its shaft 18 are permitted to rotate relative to the normally stationary shaft 17. The direction sensor 5 is suspended from the shaft 17 and includes weights 21 which provide inertia for the field coil 18 and shaft 19 which rotates with it. Similarly, the vertical direction or directional component, that is the pitch is sensed by means of a potentiometer 22 rigidly secured on a shaft 23. A frame 24 of the sensor functions as a counterbalance for the potentiometer 22. A pendulum effect is employed in that the shaft 19, potentiometer 20, and weights 21 are suspended from the shaft 23. The U.S. Pat. No. 2,761,666 also discloses a suitable pendulum type direction sensor, the output signals of which can be wirelessly transmitted according to the present invention to the remote control unit 6.

After a comparison by the operator of the detected direction and the reference line direction, if necessary, a remote adjustment of the boring machine direction is made. That is, the drive motor 14 is remotely actuated so as to properly position the rotatable cam 12. Because the auger and cutting head are rotatably driven during operation of the boring machine, a suitable counter-rotating unit 26 cooperates with at least the drive motor 14, gear reduction unit 15 and axle 17 supporting the direction sensor 5 so that these components are not rotated during operation of the boring machine. Preferably, the entire assembly of battery pack 16, control unit 7, drive motor 14, gear reduction unit 15 and axle 17 with direction sensor 5 are held stationary by the counter-rotating unit 26 which may, for example, be operated in response to gravity actuated mercury switches which sense initial rotational movement by the assembly.

The assembly of the battery pack 16, control unit 7, drive motor 14 and gear reduction unit 15 can advantageously be supported within the bore of the lead auger section by bearings. The tendency for this assembly to rotate as a reaction to the torque developed by the rotating auger is countered by the counter-rotating unit which, for example, may include counter-rotating elements which are counter-rotated by methods akin to those used in counter-rotating airplane propeller blades. In this way, the opposing torques are balanced out so that a stationary assembly and direction sensor 5 result.

While the lead auger of the present invention must be of special construction so as to accept the battery pack, control unit, counter-rotating unit, drive motor and gear reduction unit, it is envisioned that these components be transferable among various sized lead augers which are of standard length and connector size so as to be compatible with existing commercially available equipment.

In regard to the wireless transmission of information between the various units discussed above (for example between the control unit 7 and the remote control unit 6) any suitable conventional transmission and reception arrangement could be used. For example, the voltage levels sensed by the sensor 5 could be encoded by the control unit 7 and used in a conventional manner to modulate a radio frequency carrier wave for wireless transmission to the remote control unit 6. A receiver in the remote control unit 6 can then demodulate and decode the received signal from the control unit 7 for conversion to a display unit in the remote control unit. Alternately, the received information could be used in an automatic comparison system for comparing with the directional reference information as discussed previously. Similarly, the control information from the remote control unit 6 to the boring head can be accomplished in the same manner.

The earth boring machine and method of the present invention readily lend themselves to use in a field where, for example, prior to boring, a surveyor has driven stakes in the ground above the desired points of initiation and termination of the bore. By simply setting up the laser beam emitter at the desired point of termination and by placing the laser beam receiver directly in front of or behind the bore pit at the desired point of initiation, a laser beam reference line can be established for a hole to be bored. Further, according to the method of the present invention, the direction of this reference line is determined. Thereafter, the direction of the cutting head in a bore hole is determined and a comparison of these directions is made. Finally, control of the cutting head to adjust the direction of the cutting head to the direction of the reference line is accomplished. The method and machine of the present invention do not require the use of interfering apparatus above the ground, such as over an intervening roadway or railroad track. The boring machine of the present invention also does not require the use of casing pipe during boring nor does it require the manufacture of totally new and untried machines and augers. Detrimental side effects such as overcutting and multiple connections of hydraulic or electric lines are avoided by the present invention and no pilot holes, detector holes or secondary excavations are necessary.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. Remote controlled earth boring machine comprising, means for boring a hole through the earth, said means for boring including a cutting head and auger means connected to said cutting head, means for detecting the direction of said boring means in a bore hole, means for adjusting the direction of said boring means in a bore hole, means for producing an above-ground reference line for a hole to be bored, said reference line extending in a direction having at least a directional component which is essentially parallel to a corresponding directional component of said hole to be bored, means for detecting the direction of at least said directional component of said reference line, and means for remotely controlling said adjusting means whereby the direction of said boring means can be adjusted to at least said directional component of said reference line.

2. The remote controlled earth boring machine according to claim 1, wherein said means for producing an above-ground reference line provides a light beam as said reference line.

3. The remote controlled earth boring machine according to claim 1, wherein said means for producing an above-ground reference line provides a laser beam as said reference line.

4. The remote controlled earth boring machine according to claim 3, wherein said means for detecting the direction of at least said directional component of said reference line includes a laser beam receiver means.

5. The remote controlled earth boring machine according to claim 1, wherein said reference line extends in a direction having at least a horizontal directional component which is essentially parallel to the horizontal directional component of said hole to be bored, and wherein said means for detecting the direction of at least said directional component of said reference line detects at least the horizontal directional component of said reference line.

6. The remote controlled earth boring machine according to claim 1 or 5, wherein said reference line extends in a direction having at least a vertical directional component which is essentially parallel to the vertical directional component of said hole to be bored, and wherein said means for detecting the direction of at least said directional component of said reference line detects the vertical directional component of said reference line.

7. The remote controlled earth boring machine according to claim 1, wherein said means for detecting the direction of said boring means in a bore hole includes a direction sensor in said boring means and radio transmitting means for the wireless transmission of detected direction signals to a remote location.

8. The remote controlled earth boring machine according to claim 1, wherein said means for adjusting the direction of said boring means in a bore hole includes at least one adjustable peripheral cutter in said cutting head.

9. The remote controlled earth boring machine according to claim 8, wherein said means for adjusting the direction of said boring means in a bore hole further includes a rotatable cam in said cutting head for adjusting the position of said at least one peripheral cutter.

10. The remote controlled earth boring machine according to claim 9, wherein said means for adjusting the direction of said boring means further includes push rod means extending between said cam and each adjustable peripheral cutter for adjusting the position thereof with relative rotation between said cam and said at least one peripheral cutter.

11. The remote controlled earth boring machine according to claim 10, wherein said means for adjusting the direction of said boring means further includes drive motor means for adjusting the position of said cam and power source means for oprating said drive motor means, said power source means operating said drive motor means in response to said remote control means.

12. The remote controlled earth boring machine according to claim 11, wherein said auger means includes a lead auger section connected to said cutting head, said drive motor means and said power source means being located in said lead auger section.

13. The remote controlled earth boring machine according to claim 12, wherein said drive motor means is an electric motor and said power source means is a battery pack.

14. The remote controlled earth boring machine according to claim 8, wherein said means for adjusting the direction of said boring means in a bore hole includes a plurality of adjustable peripheral cutters in said cutter head.

15. Remote controlled earth boring machine for forming a bore having a generally round cross section in the earth along a predetermined course comprising, a rotatable cutting head, auger means connected to said cutting head for rotation therewith, drive means for rotating said auger means and cutting head to bore a hole in the earth, means for detecting the direction of the cutting head in a bore hole, means for adjusting the direction of the cutting head in a bore hole, said means for adjusting including cutting head adjusting motor means and power source means for operating said cutting head adjusting motor means, said cutting head adjusting motor means and said power source means being located entirely within at least one of said auger means and said cutting head, and means for remotely controlling said cutting head adjusting motor means.

16. The remote controlled earth boring machine according to claim 15, wherein said drive means for rotating said auger means and said cutting head includes a drive motor which is positioned outside of the bore hole.

17. The remote controlled earth boring machine according to claim 15, wherein said means for detecting the direction of the cutting head in a bore hole includes a direction sensor located in said cutting head and radio transmitting means for the wireless transmission of detected direction signals to a remote location.

18. The remote controlled earth boring machine according to claim 17, wherein said radio transmitting means is located in a lead auger section of said auger means adjacent said cutting head.

19. Remote controlled earth boring machine comprising, a cutting head, auger means including a lead auger section connected to said cutting head, drive means for rotating said auger means and cutting head to bore a hole in the earth, means for detecting the direction of the cutting head in a bore hole, means for adjusting the direction of the cutting head in a bore hole, said means for adjusting including cutting head adjusting motor means and power source means for operating said cutting head adjusting motor means, said cutting head adjusting motor means and said power source means being located within at least one of said lead auger section and said cutting head, and means for remotely controlling said cutting head adjusting motor means, wherein said cutting head is an adjustable cutting head and said means for adjusting the direction of the cutting head in a bore hole includes at least one adjustable peripheral cutter in said cutting head.

20. The remote controlled earth boring machine according to claim 19, wherein said means for adjusting the direction of said adjustable cutting head in a bore hole further includes a rotatable cam in said cutting head for adjusting the position of said at least one peripheral cutter.

21. The remote controlled earth boring machine according to claim 20, wherein said means for adjusting the direction of said cutting head in a bore hole further includes push rod means extending between said cam and each adjustable peripheral cutter for adjusting the position thereof with relative rotation between said cam and said at least one peripheral cutter.

22. The remote controlled earth boring machine according to claim 20, wherein said cutting head adjusting motor means adjusts the position of said cam, said power source means operating said cutting head adjusting motor means in response to said remote control means.

23. The remote controlled earth boring machine according to claim 22, wherein said cutting head adjusting motor means and said power source means are located in said lead auger section.

24. The remote controlled earth boring machine according to claim 23, wherein said cutting head adjusting motor means is an electric motor and said power source means is a battery pack.

25. Remote controlled earth boring machine for forming a bore having a generally round cross section in the earth along a predetermined course comprising, a rotatable cutting head, auger means connected to said cutting head for rotation therewith, drive means for rotating said auger means and cutting head to bore a hole in the earth, means for detecting the direction of the cutting head in a bore hole, said direction detecting means including a direction sensor located in or adjacent said cutting head and radio transmitting means for the wireless transmission of detected direction signals to a remote location, means for adjusting the direction of the cutting head in a bore hole, said means for adjusting including power source means for effecting said adjusting, said power source means being located entirely in at least one of said cutting head and said auger means whereby multiple connections from a remote power source means are avoided, and means for remotely controlling said adjusting means.

26. Apparatus for boring a hole through the earth comprising, means for producing an above-ground reference line for a hole to be bored, said reference line extending in a direction having at least a directional component which is essentially parallel to a corresponding directional component of said hole to be bored, means for detecting the direction of at least said directional component of said reference line, means for boring a hole through the earth, said means for boring including a cutting head and auger means connected to said cutting head, means for detecting the direction of said boring means in a bore hole, means for adjusting the direction of said boring means in a bore hole, and means for controlling said adjusting means whereby the direction of said boring means can be adjusted to at least said directional component of said reference line.

27. Method of boring a hole through the earth with an earth boring machine including a cutting head and auger means connected to said cutting head comprising producing an above-ground reference line for a hole to be bored, said reference line extending in a direction having at least a directional component which is essentially parallel to a corresponding directional component of said hole to be bored, determining the direction of at least said directional component of said reference line, determining the direction of the cutting head in a bore hole, comparing the direction of the cutting head in the bore hole and the direction of at least said directional component of the reference line for the hole to be bored, and controlling the cutting head to adjust the direction of the cutting head to at least said directional component of said reference line.

28. The method according to claim 27, wherein said reference line is a laser beam.

29. The method according to claim 28, wherein the step of determining the direction of the cutting head in a bore hole involves sensing the direction of the cutting head in a bore hole with a sensor and wirelessly transmitting detected direction signals to a remote location for said comparing step.

30. Earth boring machine comprising, a cutting head, auger means including a lead auger section connected to said cutting head, drive means for rotating said auger means and cutting head to bore a hole in the earth, means for detecting the direction of the cutting head in a bore hole, means for adjusting the direction of the cutting head in a bore hole, said means for adjusting including cutting head adjusting motor means and power source means for operating said cutting head adjusting motor means, said cutting head adjusting motor means and said power source means being located entirely within at least one of said lead auger section and said cutting head, and means for controlling said cutting head adjusting motor means of said adjusting means.

31. The method of boring a hole through the earth according to claim 27, wherein said reference line extends in a direction which is essentially parallel to the direction of said hole to be bored, the direction of said reference line being determined and compared with the direction of the cutting head, and wherein said controlling step involves controlling the cutting head to adjust the direction of the cutting head to the direction of said reference line.

* * * * *